US008167287B2

(12) United States Patent
Horiuchi et al.

(10) Patent No.: US 8,167,287 B2
(45) Date of Patent: May 1, 2012

(54) JIG

(75) Inventors: Ryosuke Horiuchi, Hyogo (JP); Shoichi Bairaku, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 323 days.

(21) Appl. No.: 12/190,021

(22) Filed: Aug. 12, 2008

(65) Prior Publication Data

US 2009/0051096 A1 Feb. 26, 2009

(30) Foreign Application Priority Data

Feb. 14, 2006 (JP) ..... 2006-037083

(51) Int. Cl.
*B25B 5/06* (2006.01)

(52) U.S. Cl. ..... 269/6; 269/3; 269/300

(58) Field of Classification Search ..... 269/6, 3, 269/71, 95, 58, 300, 303
See application file for complete search history.

(56) References Cited

U.S. PATENT DOCUMENTS

| | | | | |
|---|---|---|---|---|
| 2,112,789 | A * | 3/1938 | Ross | 269/315 |
| 5,101,573 | A * | 4/1992 | Mills et al. | 33/600 |
| 5,810,341 | A * | 9/1998 | Williams | 269/37 |
| 6,427,993 | B1 * | 8/2002 | Prochac | 269/37 |
| 6,568,441 | B2 * | 5/2003 | Jones | 144/253.2 |
| 7,484,310 | B2 * | 2/2009 | Jaffers et al. | 33/613 |
| 7,546,691 | B2 * | 6/2009 | Mackey | 33/613 |
| 2005/0184439 | A1 * | 8/2005 | Janson et al. | 269/6 |
| 2009/0051096 | A1 * | 2/2009 | Horiuchi et al. | 269/303 |

FOREIGN PATENT DOCUMENTS

| | | | |
|---|---|---|---|
| JP | 59-138711 | U | 9/1984 |
| JP | 2-122302 | U | 10/1990 |
| JP | 2001-200705 | A | 7/2001 |
| JP | 2002-371805 | A | 12/2002 |
| JP | 2007-032504 | A | 2/2007 |
| JP | 2007-187310 | A | 7/2007 |

OTHER PUBLICATIONS

Japanese Office Action dated Feb. 1, 2011, issued in corresponding Japanese Patent Application No. 2006-037083.

* cited by examiner

*Primary Examiner* — Lee D Wilson
(74) *Attorney, Agent, or Firm* — Westerman, Hattori, Daniels & Adrian, LLP

(57) ABSTRACT

A jig is used for positioning a retaining ring that retains a seal ring in an inner periphery of a blade ring relative to the blade ring that constitutes a gas passage of a turbine. The jig includes a base that determines a measurement point on the blade ring, a shaft arranged displaceably relative to the base, a probe that is fixed to the shaft and determines a measurement point on the retaining ring, and a measuring unit that is arranged in the base and measures a displacement amount of the shaft relative to the base.

5 Claims, 8 Drawing Sheets

FIG.8

62

| MEASUREMENT POINTS ON RETAINER RING SIDE | BLADE RING OF 2ND-STAGE STATOR VANES | BLADE RING OF 3RD-STAGE STATOR VANES | BLADE RING OF 4TH-STAGE STATOR VANES |
|---|---|---|---|
| POINT A | (0.0) | (0.0) | |
| POINT B | +0.1 | +0.2 | |
| POINT C | -0.2 | | |
| POINT D | +0.1 | | |
| POINT E | -0.2 | | |
| POINT F | -0.1 | | |

JIG

BACKGROUND OF THE INVENTION

1. Field of the Invention

The present invention relates to a jig. More particularly, this invention relates to a jig with which a positioning work of a retaining ring of a seal ring relative to a blade ring of a turbine can be performed easily with high accuracy.

2. Related Art Statement

FIG. 9 is a schematic diagram of a conventional jig 200. A gap between a blade ring 10 of a turbine and a seal fin (not shown) of a turbine disk is sealed with a seal ring 11. The seal ring 11 is retained by a retainer ring 12 and is arranged around an inner periphery of the blade ring 10.

Disassembling and reassembling works for the blade ring 10, the seal ring 11, and the retainer ring 12 are necessary during maintenance of the turbine (for example, when replacing stator vanes 101 that constitute the blade ring 10). In the reassembling work, positioning (aligning) work of the retainer ring 12 relative to the blade ring 10 is performed. If the positioning of the retainer ring relative to the blade ring 10 is appropriate, an inappropriate gap is produced between the seal ring 11 and the seal fin, so that sufficient sealing performance can not be achieved. Rubbing due to eccentricity of the seal ring 11 may occur when a rotor rotates. Therefore, there is a demand that positioning of the retainer ring 12 relative to the blade ring 10 is performed with high accuracy.

At the positioning work of the retainer ring 12 relative to the blade ring 10, a distance between a measurement point (a reference point) on the side of the blade ring 10 and a measurement point on the side of the retainer ring 12 is measured on a plurality of points on the blade ring 10. The installation position of the retainer ring 12 relative to the blade ring 10 is fine-adjusted by taking into account the measurement values. The jig 200 that is an exclusive measuring device is used to perform the measurement (see FIG. 9). The conventional jig 200 includes a base 201, a shaft 202, a probe 203, and a measuring unit 204. When performing the measurement, the base 201 is placed on an edge of an outer peripheral side of the blade ring 10 to determine a measurement point (a reference point) on the side of the blade ring 10. The shaft 202 is fixedly mounted on the base 201 such that it extends toward an inner side in a radial direction of the blade ring 10. The probe 203 is mounted on the tip of the shaft 202 and determines a measurement point on the side of the retainer ring 12. The measuring unit 204 consists of, for example, a dial gauge and is arranged together with the probe 203 on the tip of the shaft 202.

However, in the conventional jig 200, because the measuring unit 204 is mounted on the tip of the shaft 202, the shaft 202 may be deflected by the weight of the measuring unit 204. Consequently, accurate measurement can not be performed, or the operator of the jig 200 must be highly skilled. Moreover, measurement results may vary depending on the operator.

There have been no published patent documents that disclose a jig for positioning a blade ring of a turbine and a retaining ring.

SUMMARY OF THE INVENTION

It is an object of the present invention to provide a jig that can facilitate positioning of a blade ring and a retaining ring of a seal ring of a turbine with high accuracy.

To achieve the above object, according to an aspect of the present invention, there is provided a jig used for positioning a retaining ring that retains a seal ring in an inner periphery of a blade ring relative to the vane ring that constitutes a gas passage of a turbine. The jig includes a base that determines a measurement point on the blade ring side; a shaft that is arranged displaceably relative to the base; a probe that is fixed on the shaft and determines a measurement point on the retaining ring side; and a measuring unit that is arranged on the base and measures a displacement amount of the shaft relative to the base.

In the above jig, the measuring unit is arranged on the base, so that deflection of the shaft by the weight of the measuring unit is unlikely to occur compared with the conventional jig that has the measuring unit arranged on the tip of the shaft. Therefore, accurate measurements can be performed with this jig, so that there is an advantage that positioning of a retaining ring relative to a blade ring can be performed easily with high accuracy.

BRIEF DESCRIPTION OF THE DRAWINGS

FIG. 5 to FIG. 9 are schematic diagrams illustrating states of the uses of the jig shown in FIG. 1.

DETAILED DESCRIPTION OF THE INVENTION

Figure 1:
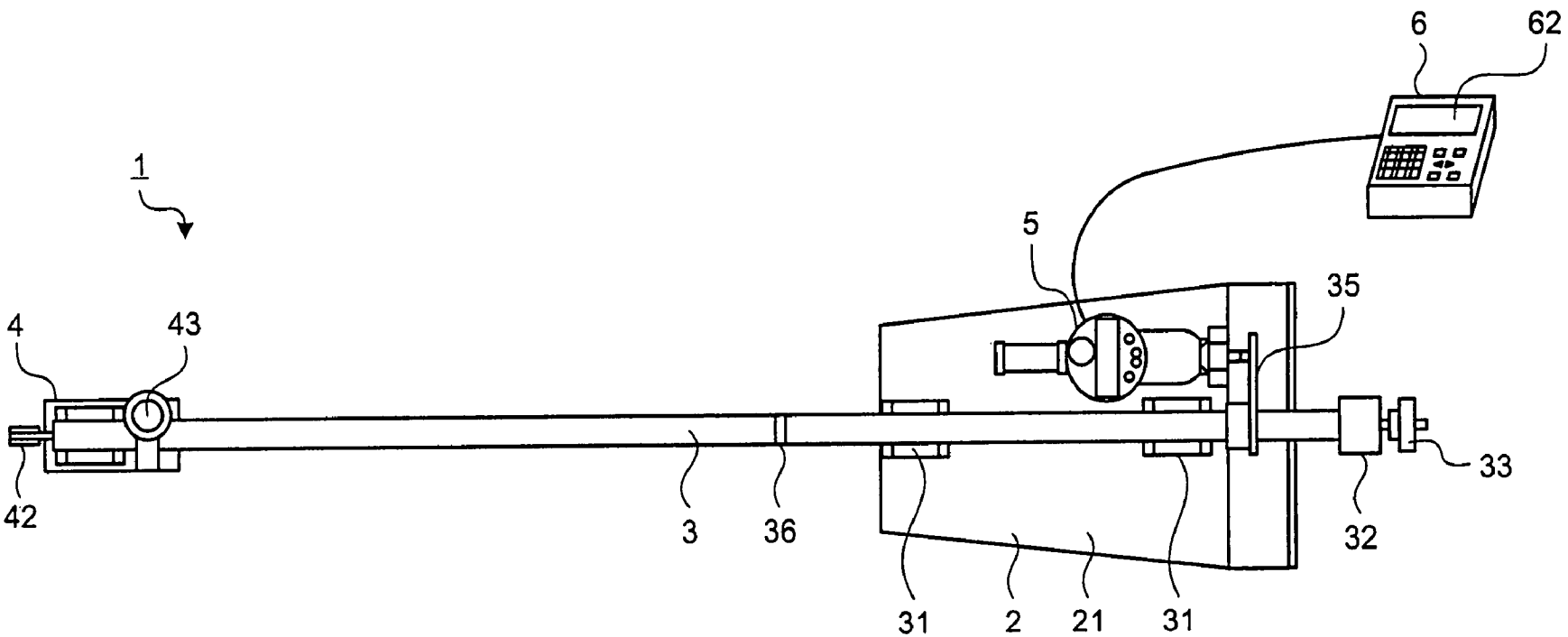
FIG. 1 and FIG. 2 are a plan view (FIG. 1) and a side view (FIG. 2) illustrating a jig according to an example of the present invention.

Exemplary embodiments of the present invention are explained in detail below with reference to the accompanying drawings. The present invention is not limited to these embodiments. The constituent elements hereinafter may include one replaceable or easy to produce by a person skilled in the art, or one substantially similar thereto. The various modifications hereinafter can be combined with one another arbitrarily in consideration of obvious facts among persons skilled in the art.

Example 1

A jig 1 is used for positioning (aligning) of the blade ring 10 and the retainer ring 12 of the seal ring 11, for example, when reassembling a turbine at maintenance and the like. The jig 1 includes a base 2, a shaft 3, a probe 4, a measuring unit 5, and a data processing unit 6 (see FIG. 1 to FIG. 4).

When performing measurement, the base 2 abuts an edge of an outer peripheral side (a machined reference plane) of the blade ring 10 to determine a measurement point (a reference point) on the side of the blade ring 10. The base 2 includes a base plate 21, a plurality of base legs 22, and a guide roller 23 (see FIG. 1 and FIG. 2). The base plate 21 is, for example, a plate-like member made of aluminum, and has a generally trapezoidal shape in a plan view. The base legs 22 are mounted on the base plate 21 (see FIG. 2 and FIG. 3). The base legs 22 are resin ball casters and abut on a base portion 103 of the blade ring 10 when installing the jig 1. The guide roller 23 consists of, for example, a resin ball caster, and is fixed to the base plate 21 via a cross-sectional L-shaped attachment bracket. The guide roller 23 is arranged at the lower part of the side portion of the base 2 and abuts on an outer periphery of the base portion 103 of the blade ring 10 at measurement. The jig 1 is moveable in a circumferential direction along the edge of the outer peripheral side of the blade ring 10 by the base legs 22 and the guide roller 23 of the base 2.

Figure 2:
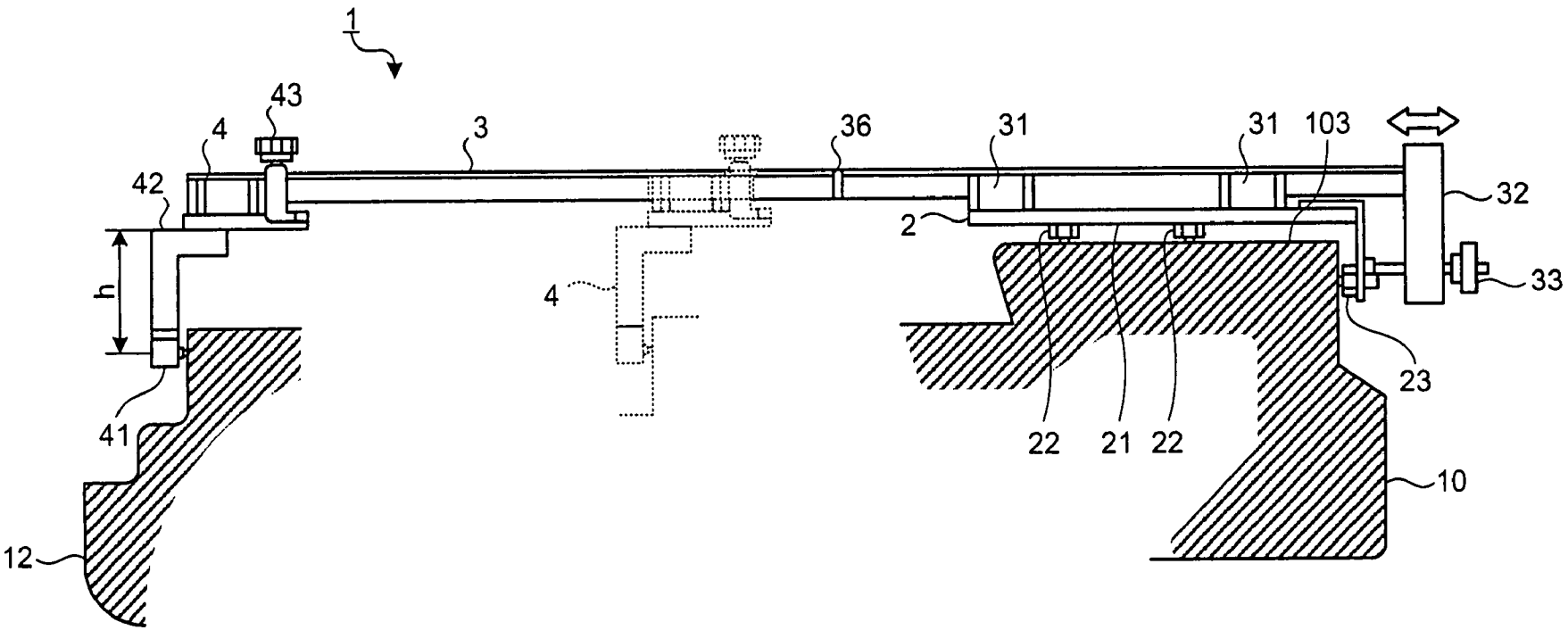
Figure 3:
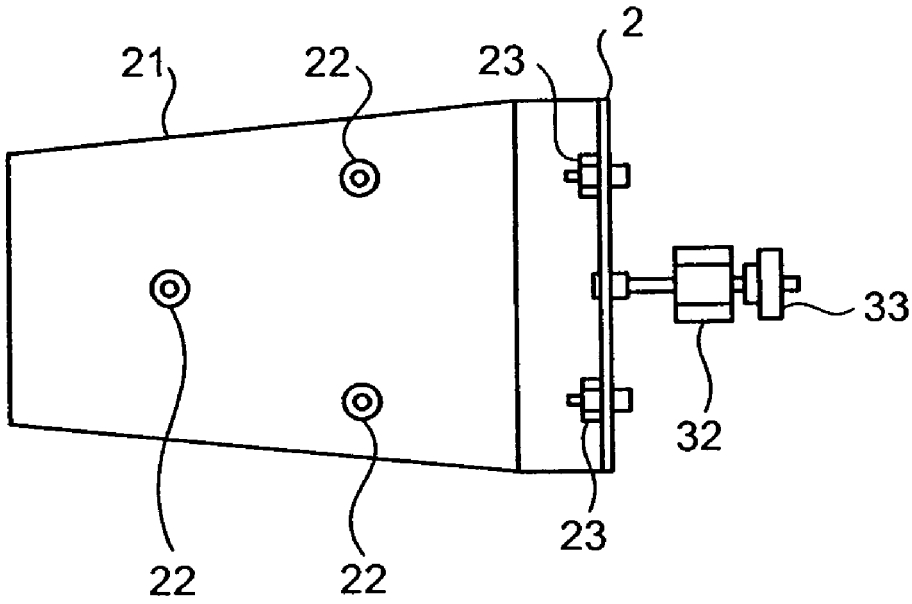
FIG. 3 is a rear view of a base plate of the jig shown in FIG. 1.

The shaft 3 consists of, for example, a long member (a hollow shaft) made of aluminum, and is installed on the base 2 such that the shaft 3 extends toward the inner side in a radial direction of the blade ring 10 when measurement is performed (see FIG. 1 and FIG. 2). The shaft 3 is mounted displaceably in a longitudinal direction (an axial direction) relative to the base 2. In this example, a plurality of guides 31 that consists of ball spline bearings is fixed on the base 2 (the base plate 21) and the shaft 3 is arranged while being supported by the guides 31. The shaft 3 is slideable in the longitudinal direction (the radial direction of the blade ring 10) on the base 2 while being guided by the guides 31. A manual handle 33 is mounted on the end of the shaft 3 on the side of the base 2 through a handle bracket 32. The displacement amount (slide amount) of the shaft 3 is adjusted by rotating the manual handle 33.

The probe 4 abuts on the inner periphery of the retainer ring 12 at measurement and determines a measurement point on the side of the retainer ring 12 (see FIG. 1 and FIG. 2). The probe 4 includes a sharp-pointed probe terminal 41 and a probe holder 42 that holds the probe terminal 41, and is fixed on the tip portion of the shaft 3 with the probe holder 42. The probe holder 42 is made of lightweight aluminum.

A measuring unit (measuring instrument) 5 measures displacement amount of the shaft 3 relative to the base 2 (see FIG. 1 and FIG. 2). The measuring unit 5 is, for example, a digital dial gauge and is arranged on the base plate 21 of the base 2. Specifically, the measuring unit 5 measures the displacement amount of a press plate 35 fixed on the shaft 3 (slide amount of the shaft 3), so that the displacement amount at the measurement point on the side of the retainer ring 12 is measured.

The data processing unit (data logger) 6 is provided to be connected to the measuring unit 5 and processes measurement values obtained from the measuring unit 5 (see FIG. 1). For example, the data processing unit 6 records measurement values from the measuring unit 5. The recorded measurement values are entered into a record form (inspection sheet) and are displayed on a display screen 62 of the data processing unit 6 (see FIG. 8) to allow viewing of the measurement values. The data processing unit 6 is connected to a PC (personal computer) as necessary and the measurement values are transferred to the PC to generate a measurement record.

Figure 6:
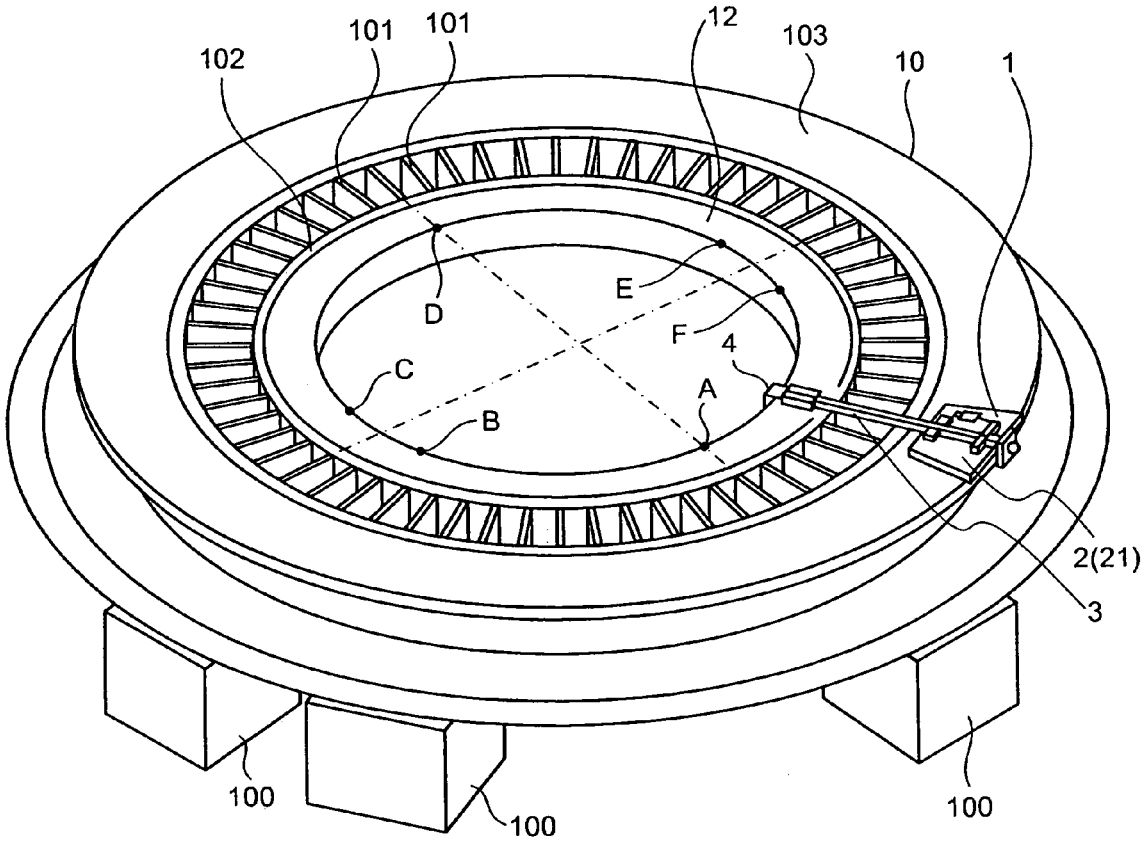
Figure 7:
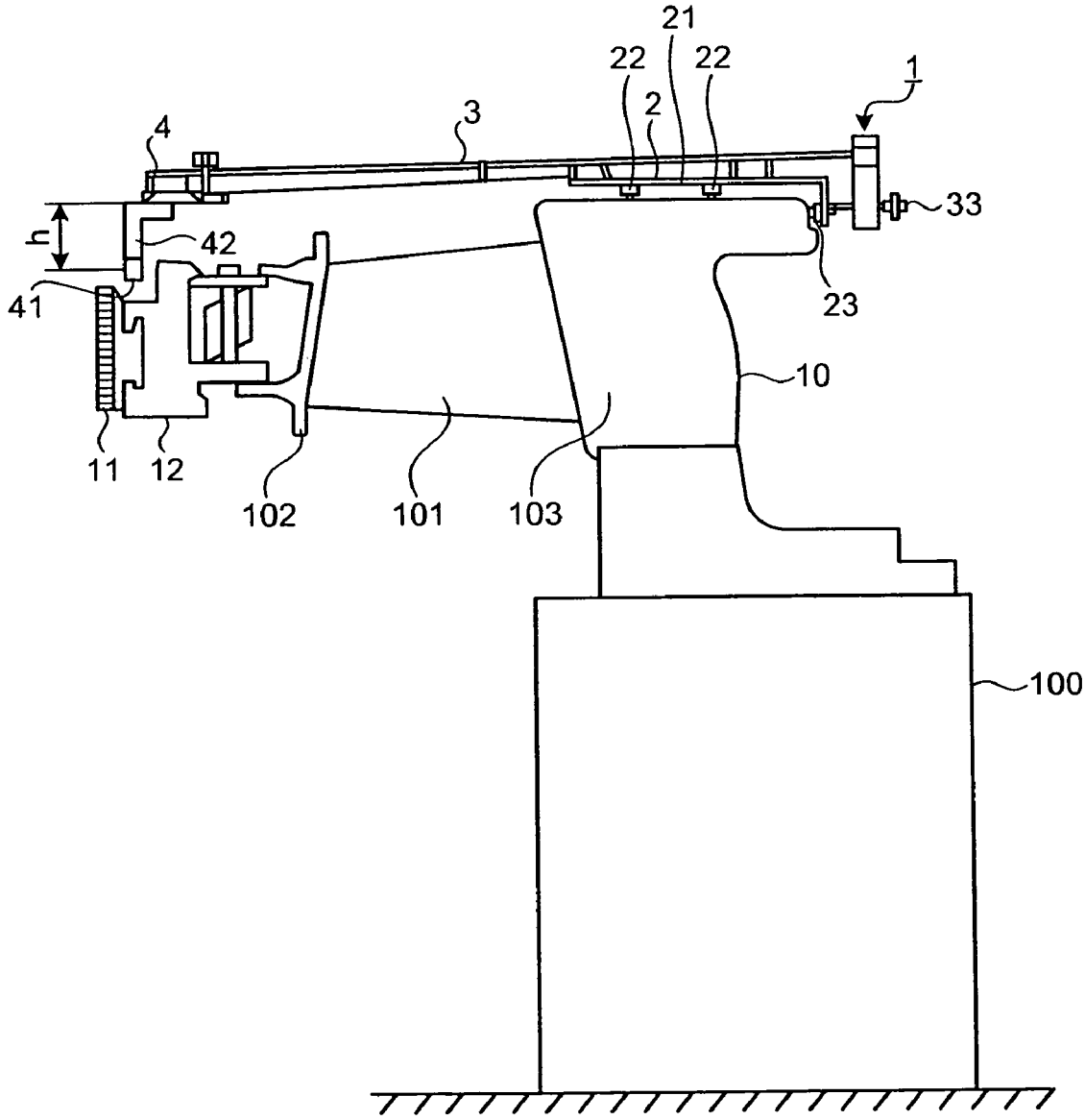

The blade ring 10 of the turbine, for which the jig 1 is used, includes a number of the stator vanes 101 arranged annularly to constitute gas passages for the turbine (see FIG. 6 and FIG. 7).

The base portion 103 of the blade ring 10 is machined along the edge of the outer peripheral side of the blade ring 10. When positioning the retainer ring 12 relative to the blade ring 10, measurements are performed relative to the machined portion of the blade ring 10 that is the reference plane. The seal ring 11 is arranged around the inner periphery of the blade ring 10 to seal a gap with the seal fin of the turbine disk. The seal ring 11 is retained by the retainer ring 12 mounted in the inner periphery of the blade ring 10. The retainer ring 12 is fixed to a flange of a shroud 102 inside the stator vanes 101. The jig 1 is used for, such as positioning the retainer ring 12 relative to the blade ring 10 of the 2nd-stage stator vanes 101 to the 4th-stage stator vanes 101 of the turbine.

The positioning work of the retainer ring 12 relative to the blade ring 10 is explained (see FIG. 5 to FIG. 8). In the positioning work, the retainer ring 12 and the seal ring 11 are temporarily installed in the blade ring 10 (ST1) and the blade ring 10 is placed onto a plurality of work blocks 100 (see FIG. 5 and FIG. 6). The jig 1 is mounted relative to the blade ring 10 (ST2). The mounting of the jig 1 is such that the base 2 (the base plate 21) is placed on the base portion 103 of the blade ring 10 with the shaft 3 facing toward the inner side in the radial direction of the blade ring 10 and the probe 4 locating on the inner peripheral side of the retainer ring 12 (see FIG. 7).

The position of the retainer ring 12 relative to the blade ring 10 is measured (ST3). At the measurement, the guide roller 23 of the base 2 of the jig 1 is caused to abut on the outer periphery of the base portion 103 (see FIG. 6 and FIG. 7), so that the measurement point (the reference point) on the side of the blade ring 10 is determined. The shaft 3 slides in the radial direction of the blade ring 10 by operating the manual handle 33 to cause the probe terminal 41 to abut on the inner periphery of the retainer ring 12, which determines the measurement point on the side of the retainer ring 12. Then, the measuring unit 5 obtains the displacement amount (slide amount) of the shaft 3 as the measurement value. In this example, an arbitrary point (for example, point A in FIG. 6) is set to be the reference point and the relative measurement value is obtained at each of the points (for example, point B to point F). These measurement values are transferred to the data processing unit 6 from the measuring unit 5 to be recorded, and displayed on the display screen 62 of the date processing unit 6 together with the record form (see FIG. 8).

Based on the measurement values, whether the position of the retainer ring 12 is appropriate is determined (ST4). For example, when the measurement value is within the predetermined set range, the positioning of the retainer ring 12 relative to the blade ring 10 is determined as appropriate. If determined so, the jig 1 is removed (ST5), and the positioning work ends. By contrast, when measurement value is not within the predetermined set range, the installation position of the retainer ring 12 relative to the blade ring 10 is fine-adjusted (ST6). Accordingly, positioning of the retainer ring 12 relative to the blade ring 10 is properly performed. The positioning work is performed on each of the blade rings 10 of the 2nd-stage stator vanes to the 4th-stage stator vanes of the turbine (see FIG. 8).

Figure 9:
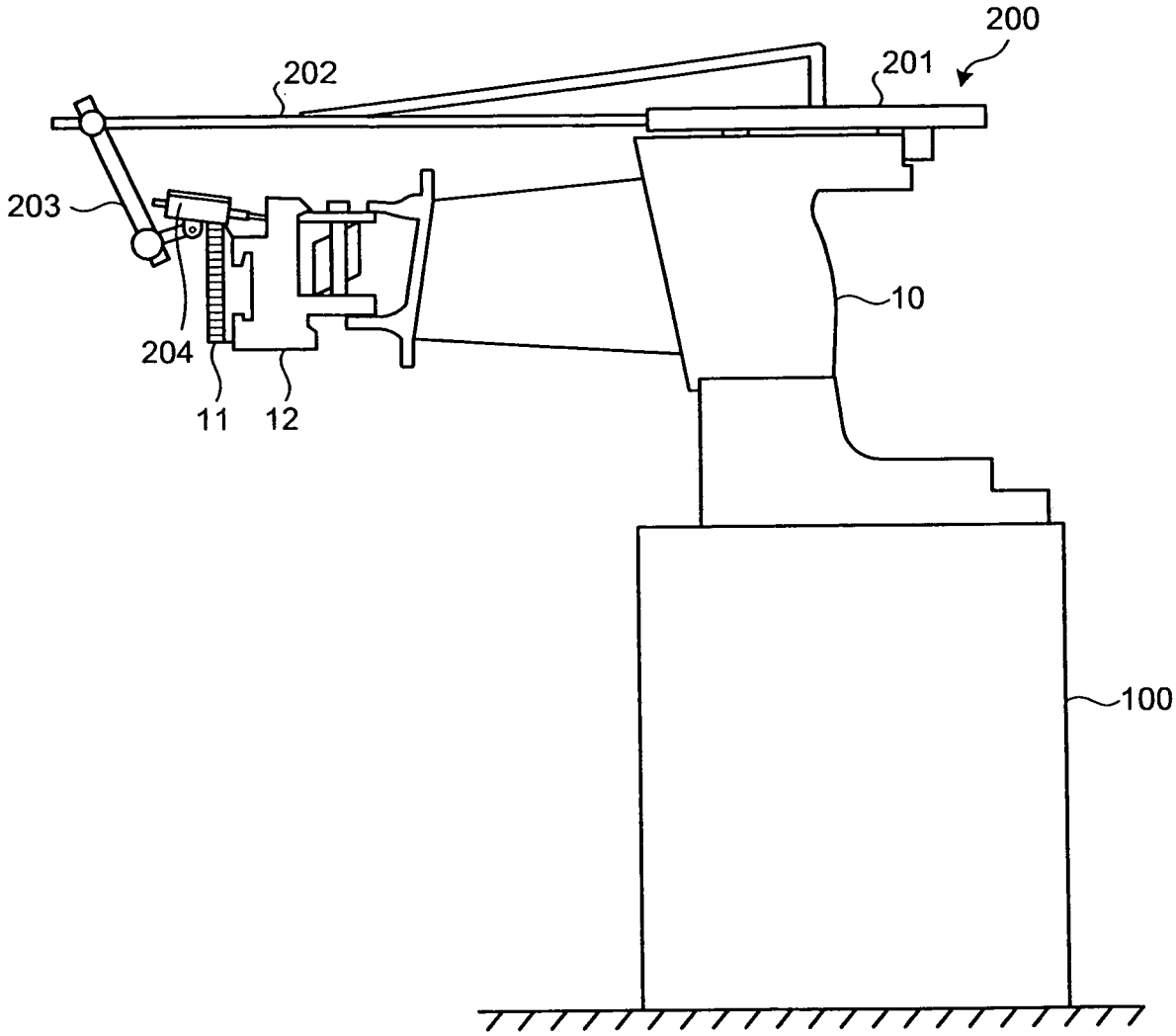

The measuring unit 5 is arranged on the base 2 for the jig 1, so that deflection of the shaft 3 by the weight of the measuring unit 5 is unlikely to occur compared with the jig 200 of a related art (see FIG. 9) that has the measuring unit 204 arranged on the tip of the shaft 202. Accordingly, accurate measurement values can be obtained, so that there is an advantage that positioning of the retainer ring 12 relative to the blade ring 10 can be performed with high accuracy.

With this configuration, the displacement amount of the shaft 3 relative to the base 2 is obtained as the measurement value at measurement, so that measurement is easier compared with the jig of a related art with which the position of the retainer ring 12 is directly measured by a needle of a dial gauge. Therefore, there is an advantage that positioning work of the retainer ring 12 relative to the blade ring 10 can be performed easily. This leads to reduction of difference in the measurement value among individual operators. Thus, there is an advantage that measuring accuracy is made uniform and the positioning accuracy of the retainer ring 12 relative to the blade ring 10 is improved.

In the jig 1, the shaft 3 is slideable relative to the base 2 and the displacement amount (slide amount) is obtained as the measurement value (see FIG. 1 and FIG. 2), so that the measurement is easy. Accordingly, there is an advantage that the positioning work of the retainer ring 12 relative to the blade ring 10 can be easily performed. Especially, this configuration is preferable in that errors in reading values are unlikely to occur compared with the measurement by the dial gauge mounted on the tip of the shaft 202.

Figure 4:
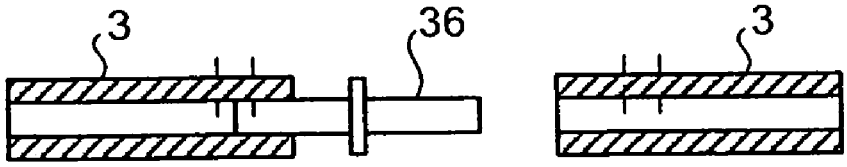
FIG. 4 is a schematic diagram of a shaft of the jig shown in FIG. 1.
Figure 5:
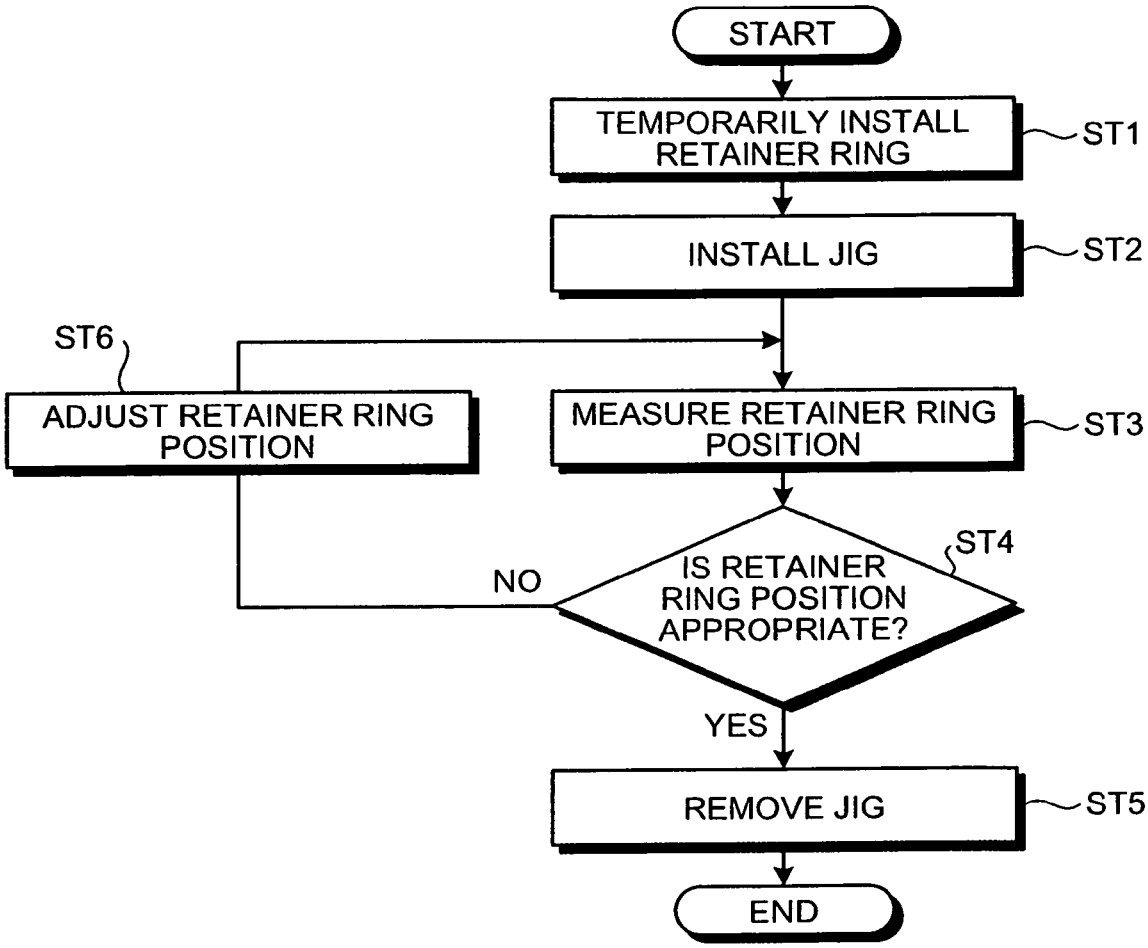

It is also preferable that the shaft 3 of the jig 1 have a separable structure (see FIG. 4). The long shaft 3 can be made portable by separating and the delivery of the jig 1 can be made easy. For example, the shaft 3 of the jig 1 is separable into pieces each having a length of about 600 [mm]. The pieces of the shaft 3 are connected to each other at joints 36 and are fixed with bolts to be a one-piece member.

It is also preferable that the installation position of the probe 4 be changeable relative to the shaft 3 in the jig 1 (see FIG. 1 and FIG. 2). This allows to change the installation position of the probe 4 depending on the measuring target. Thus, there is an advantage that measurement work can be made easy and measurement accuracy is improved. For example, the probe holder 42 is fixed to the shaft 3 with an installation screw 43 in this example. When measurement is performed, the position of the probe holder 42 is adjusted by loosening the installation screw 43 according to the measuring target (each of the blade rings 10 of the 2nd-stage stator vanes to the 4th-stage stator vanes).

It is also preferable that the probe 4 of the jig 1 have a detachable structure (see FIG. 2 and FIG. 7). This allows to employ the probe 4 of a different size h in accordance with the measuring target (work height). Thus, there is an advantage that the measuring work can be made easy and the measurement accuracy is improved. For example, the probe holder 42 is configured to be detachable from the shaft 3 in this example. When measurement is performed, the probe holder 42 having a preferable size h is selected in accordance with the measuring target and is installed on the shaft 3.

What is claimed is:

1. A jig used for positioning a retaining ring that retains a seal ring in an inner periphery of a blade ring relative to the blade ring that constitutes a gas passage of a turbine and is moveable in a circumferential direction along an outer periphery of the blade ring, the jig comprising:

a base that determines a measurement point on the blade ring side, and includes base legs mounted on a bottom surface of the base and a guide roller mounted on a side portion of the base;

a shaft that is arranged displaceably relative to the base;

a probe that is fixed on the shaft and determines a measurement point on the retaining ring side; and a measuring unit that is arranged on the base and measures a displacement amount of the shaft relative to the base.

2. The jig according to claim 1, wherein the shaft is slideable relative to the base.

3. The jig according to claim 1, wherein the shaft has a separable structure.

4. The jig according to claim 1, wherein an installation position of the probe on the shaft is changeable.

5. The jig according to claim 1, wherein the probe has a detachable structure.

* * * * *